United States Patent [19]

Wallace et al.

[11] Patent Number: 4,894,976

[45] Date of Patent: Jan. 23, 1990

[54] MISSING CARD CIRCUIT FOR A SLICING MACHINE

[75] Inventors: Gary L. Wallace, Jeffersontown; Robert K. Moore, Louisville; Richard L. Beckner, Pendelton, all of Ky.

[73] Assignee: AMCA International Corporation, Hanover, N.H.

[21] Appl. No.: 236,178

[22] Filed: Aug. 25, 1988

[51] Int. Cl.[4] ..... B65B 25/08

[52] U.S. Cl. ..... 53/435; 53/157; 53/506; 53/517; 53/DIG. 1; 83/61

[58] Field of Search ..... 53/506, 505, 435, 586, 53/156, 157, DIG. 1, 69, 67, 517, 514, 513; 83/61, 58, 77, 23, 167

[56] References Cited

U.S. PATENT DOCUMENTS

| | | | |
|---|---|---|---|
| 3,183,642 | 5/1965 | Tindall | 53/517 X |
| 3,417,541 | 12/1968 | Wedl et al. | 53/506 X |
| 3,587,688 | 6/1971 | Toby | 53/505 X |
| 3,846,958 | 11/1974 | Divan | 53/153 X |
| 3,862,666 | 1/1975 | Muskat et al. | 177/50 |
| 3,995,517 | 12/1976 | Smith | 83/13 |
| 4,100,984 | 7/1978 | Klopfenstein et al. | 177/50 |
| 4,136,504 | 1/1979 | Wyslotsky | 53/435 |
| 4,226,147 | 10/1980 | Kumzi | 83/37 |
| 4,328,657 | 5/1982 | Brandmaier et al. | 53/586 |
| 4,342,182 | 8/1982 | Dennis et al. | 53/156 |
| 4,452,031 | 6/1984 | Dennis et al. | 53/586 |
| 4,545,447 | 10/1985 | Spooner et al. | 177/165 |
| 4,552,048 | 11/1985 | Wallace et al. | 83/23 |

*Primary Examiner*—James F. Coan

*Attorney, Agent, or Firm*—Burns, Doane, Swecker & Mathis

[57] ABSTRACT

An automotive slicing machine includes a circuit for monitoring the operation of a card dispenser during the processing of a sliced product. In one embodiment, when the monitoring circuit detects that a card dispensing operation has not been performed for two consecutive drafts of a sliced product, the slicing operation is halted until an operator attends to the problem.

9 Claims, 5 Drawing Sheets

MISSING CARD CIRCUIT FOR A SLICING MACHINE

BACKGROUND OF THE INVENTION

The present invention generally relates to a method and apparatus for controlling a slicing machine. More specifically, the present invention relates to a method and apparatus for monitoring the placement of cards beneath drafts of a food product, such as bacon, which have been processed by a slicing machine.

In the preparation of food products for consumer markets, such as the processing of pork bellies into packaged bacon strips, the processing and packaging of the food products is carried out cyclically. During each cycle, a front or feed conveyor transports an unsliced food product, such as a pork belly, to a slicing device. At the slicing device, or slicer, a predetermined number of slices, known as a draft, are removed from the unsliced food product and grouped onto a discharge conveyor.

The group of slices can be arranged in an overlapping or shingling manner on the discharge conveyor by moving the discharge conveyor beneath the slicer at a relatively constant speed as the unsliced food product is cut. Alternatively, as slices are removed from the unsliced food product, they may be grouped into stacks by stopping the discharge conveyor during the slicing of each draft. The predetermined number of slices may also be laid flat next to one another on the discharge conveyor by increasing the speed of this conveyor relative to the speed used to obtain a shingled arrangement.

After a draft has been sliced, the slicing operation is momentarily interrupted while at the same time, the speed of the discharge conveyor is momentarily increased. By this operation, each draft is quickly carried away from the slicer before slicing of the next draft is initiated. Thus, a space will be provided between the drafts as they are placed onto the discharge conveyor.

The sliced drafts are then transported from the discharge conveyor to a front conveyor of a card dispenser machine, which places a card beneath each draft of the sliced food product. The cards to be dispensed are placed in a magazine reservoir by the machine operator. As the card dispenser cyclically dispenses a card, a draft of the food product is moved from the front conveyor of the card dispenser into placement on the card.

After passing through the card dispenser, the sliced drafts are processed by additional material handling equipment located downstream of the card dispenser. For example, because the drafts are typically sold by weight, they are transported by a rear conveyor from the card dispenser to a check weighing machine. Bacon, for example, is typically sold in one pound packages. Drafts of the sliced product which are deemed over or under weight at the check weighing machine are diverted by an alternate conveyor, known as a reject conveyor, to a make weight conveyor whereby an operator can manually add or delete slices so as to bring the draft into weight conformity.

Drafts of the sliced product which have been deemed to conform to the desired weight or which have been compensated to conform to the desired weight are finally routed to a packaging machine. Here, the drafts are wrapped and prepared for distribution.

In processing and packaging the drafts of a sliced product such as bacon, it is important that the card dispenser machine dispense a card for each draft. Occasionally however, the operator may accidentally permit the magazine reservoir to become empty. Alternatively, a card or cards may become jammed during dispensing or transfer, and not be placed under a draft of bacon. When a card is not properly dispensed and placed beneath a draft, the drafts can become disarranged and possibly clog portions of the material handling equipment located downstream of the card dispenser. Furthermore, disarranged drafts of the sliced product which must be recarded may have to be downgraded, thus prohibiting their sale as highest grade. It is therefore important for the machine operator to know quickly that cards are not properly dispensed so that corrective action may be taken.

Thus, a need exists in the prior art for a slicing machine control system which will provide an indication to the operator when a card has not been properly dispensed beneath a sliced draft.

SUMMARY OF THE INVENTION

Accordingly, it is an object of the present invention to overcome the deficiencies of the prior art by providing a novel method and apparatus for monitoring the operation of the card dispenser during the processing of a sliced product by a slicing machine.

In the method and apparatus of the present invention, means are provided for cutting and grouping slices of a food product into drafts. From the cutting and grouping means, the drafts are transported to a card dispensing position in a card dispensing means. In accordance with the present invention, a missing card detection feature is provided which includes a circuit that monitors the card dispenser.

The monitoring circuit includes a first sensor for detecting the approach of a draft to the card dispensing position and a second sensor for detecting whether a card has been dispensed by the card dispenser. An activating means, responsive to the first and second sensors, is also provided in the monitoring circuit.

When the monitoring circuit detects that a card has not been dispensed for one draft but that a card has been dispensed for the immediately succeeding draft, no action is taken. If, however, the monitoring circuit detects that two consecutive card dispensing operations have not occurred, a missing card function is activated by the activating means. More specifically, when the monitoring circuit detects that a card has not been dispensed for one draft, and that a card has not been dispensed in a pre-allotted time period for a second draft, the missing card function is activated to cause a halting or shutdown of the slicing operation until an operator attends to the problem.

When the missing card function is activated, the front or feed conveyor which transports the unsliced food product to the slicer is stopped so that no more drafts are sliced. In addition, the operation of the card dispenser is interrupted. This interruption includes stopping the front conveyor of the card dispenser so that previously sliced drafts are not transported to a card dispensing position in the card dispenser. The rear conveyor of the card dispenser is also stopped so that uncarded drafts down line of the card dispensing position are not transferred to the reject conveyor. On the other hand, drafts which have already received cards may be permitted to complete their traverse of the slicing machine, by passing through the reject conveyor to the make weight conveyor and the packaging machine.

Upon the occurrence of a shutdown in response to activation of the missing card function, operation can be resumed by activating a reset means and then activating a start button on a system control panel. Although the number of omitted card dispensing operations which will trigger a shutdown can be adjustably preset, the requirement of at least two consecutive omissions is desirable for preventing nuisance shutdowns.

BRIEF DESCRIPTION OF THE DRAWINGS

Other objects and advantages will become apparent from the following detailed description of a preferred embodiment of the invention as described in conjunction with the accompanying drawings wherein like reference numerals are applied to like elements and wherein.

DESCRIPTION OF THE PREFERRED EMBODIMENTS

In the following description of preferred embodiments of the present invention, particular reference is made to the slicing of pork bellies to provide a practical illustration of the features and the advantages which the present invention offers. It will be appreciated, however, that the invention can be utilized with other types of products in which it is desired to place a group of processed slices onto a dispensed card or container.

Figure 1:
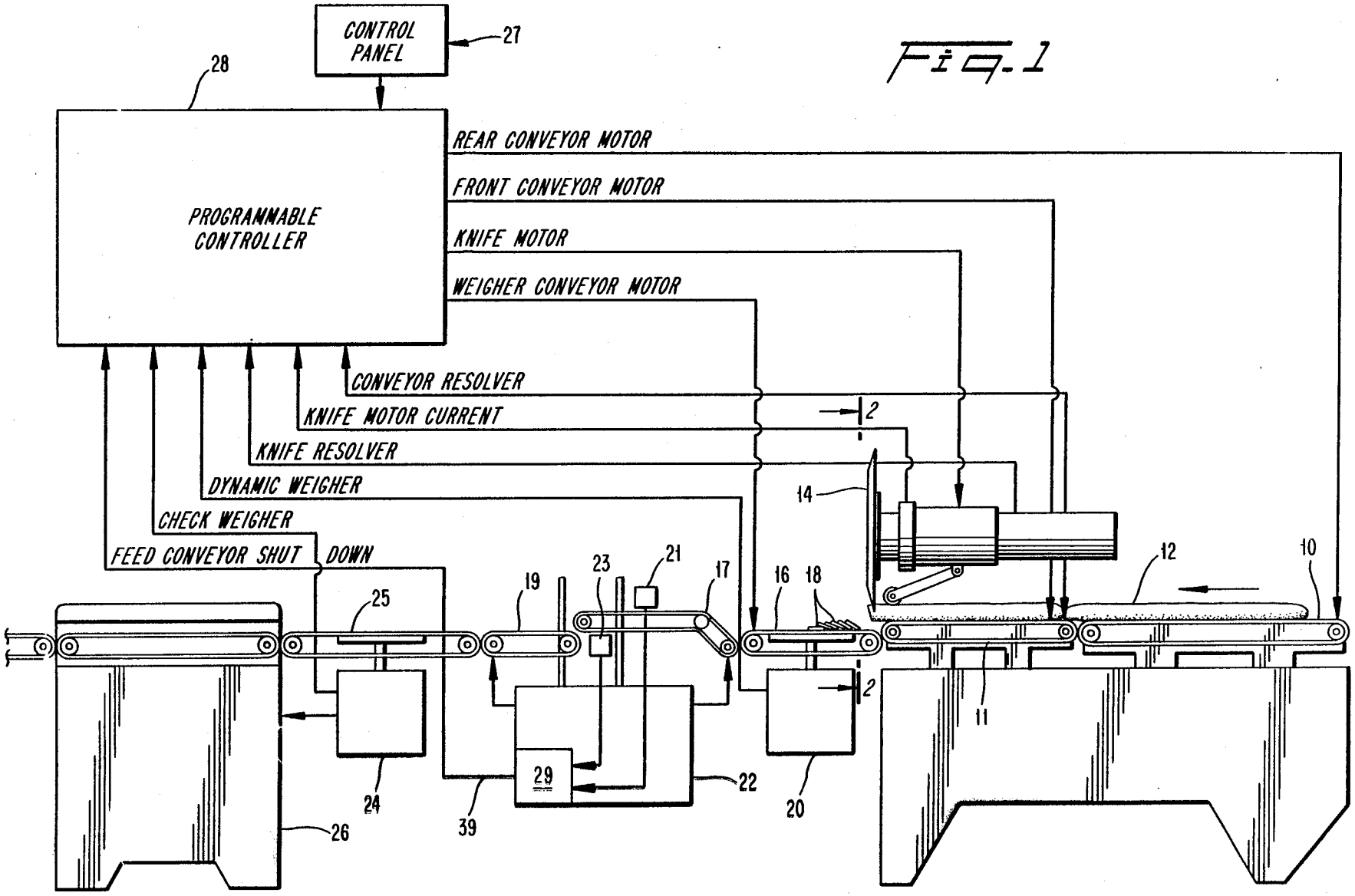
FIG. 1 is a schematic side elevation of a slicing machine, with parts removed in the interest of clarity, to which the present invention is applicable.

Referring to FIG. 1, a slicing machine that can be used for slicing bacon and other similar types of food products is shown in a schematic form. The slicing machine includes a means for cutting and grouping slices of the bacon into drafts. The cutting and grouping means includes a slicer 14 having a rear, or pusher, conveyor 10 for supplying unsliced pork bellies 12 toward a front, or feed, conveyor 11. The cutting and grouping means also includes a discharge conveyor 16. The feed conveyor 11 feeds the pork bellies 12 to a continuously rotating slicing knife of the slicer 14. The discharge conveyor 16 is disposed downstream of the feed conveyor 11 and removes the bacon slices 18, now arranged in drafts, from the vicinity of the slicing knife.

The slicing machine also includes a conveyor means 17 at the front of a card dispenser machine 22 for transporting the drafts from the cutting and grouping means to a card dispensing position in the card dispenser machine 22. In accordance with the present invention, a monitoring circuit is provided with the slicing machine to insure that the card dispenser machine properly dispenses a card beneath each draft of bacon as it is placed in the card dispensing position.

The monitoring circuit includes a first sensor 21 for detecting the approach of a draft of bacon toward the card dispensing position, and a second sensor 23 for detecting whether a card is actually dispensed. The monitoring circuit further includes an activating means 29 for initiating a missing card function when the first sensor detects the approach of a draft to the card dispensing position but the second sensor does not detect that a card has been dispensed.

After the card dispenser 22 places a card beneath each draft of bacon, processing of the carded draft by material handling equipment of the slicing machine which is located downstream of the card dispenser occurs. As shown in FIG. 1, these elements include a check weigher 24 and a reject conveyor 26. These elements also include a make weight conveyor and packaging and labelling equipment, neither of which is shown in FIG. 1.

Figure 2:
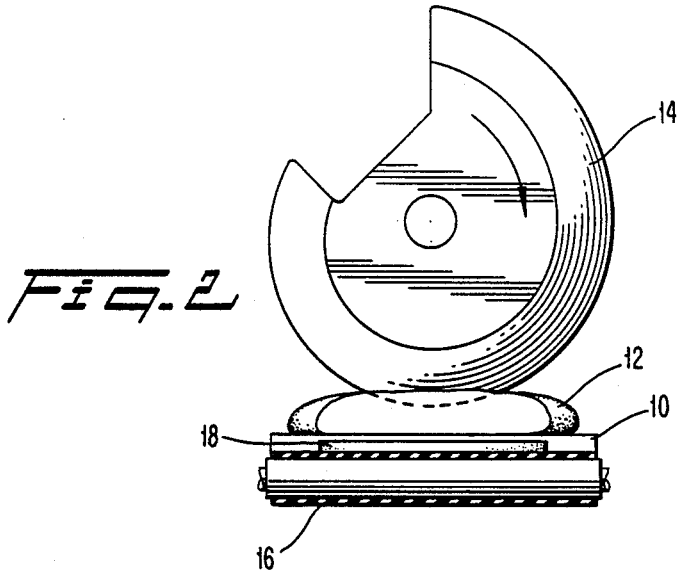
FIG. 2 is a partial schematic cross-section along lines 2—2 of the FIG. 1 slicing machine.

As is known in this art, the slicer 14 of the cutting and grouping means has a knife with an involute shape, i.e., its radius increases in a circumferential direction as best shown in FIG. 2. This knife is continuously rotated at a predetermined nominal speed by a suitable control, and during the slicing of a draft, the position of the FIG. 1 feed conveyor 11 is continuously advanced to feed a pork belly 12 into the knife. The continual feeding of the pork belly combined with the involute shape of the knife results in slices of relatively uniform thickness being sliced from the pork belly, assuming a fixed ratio of belt advancement to slicing knife speed. Because the drafts are typically sold by weight, this ratio may be continuously adjusted should it be determined that the predetermined number of slices at an existing thickness produce a draft which is over or under a desired weight.

More specifically, a first scale 20 is disposed in operative relationship with the discharge conveyor belt 16 to provide an instantaneous indication of the total weight of the slices in the draft as they are cut. This scale provides a continuous read-out of the measured weight of a sliced draft on a real time basis. The measured weight is then used as an input for adjusting the speed with which the feed conveyor 11 will advance unsliced pork bellies into the knife of the slicer 14.

For example, if the pork belly 12 is sliced too thin, an underweight draft will be detected by the scale 20. An output signal from the scale 20 will thus be used to decrease the ratio of advancement of the feed conveyor 11 relative to the speed of the slicing knife so that the thickness of the slices will be increased. Conversely, if the pork belly is sliced too thick, an overweight draft will be detected. In such a case, the ratio of feed conveyor advancement to slicing knife speed would be increased so that the predetermined number of slices constituting a draft would more nearly reflect a desired weight. As the predetermined number of slices constituting a draft are cut from the unsliced pork belly, they may be grouped in an overlapping, or shingling manner, onto the discharge conveyor 16 of FIG. 1. The predetermined number of slices may also be stacked or may be laid flat next to one another on the discharge conveyor as they are removed from the unsliced pork belly.

The cutting and grouping of slices onto the conveyor 16 in a shingled, or overlapped, arrangement, as mentioned above, is achieved by moving the discharge conveyor at a relatively constant speed while the slices of a draft of bacon are removed from the pork belly 12. The revolutions of the slicing knife are counted and after the number of slices necessary to produce a full draft have been removed from the pork belly, the feed conveyor 11 is momentarily interrupted and preferably retracted at a high speed, as disclosed in U.S. Pat. No. 4,226,147, which is hereby incorporated by reference. During this time, the speed of the discharge conveyor 16 can also be momentarily increased, thereby quickly carrying the sliced draft away from the vicinity of the slicer 14. A space on the conveyor between the most recently sliced draft and the draft that is produced when the forward advance of the feed conveyor 11 resumes is thus provided.

The slices of food product may also be grouped into drafts consisting of a predetermined number of stacked slices by stopping the discharge conveyor during the slicing of each draft. Alternatively, the predetermined number of slices constituting a draft may be laid flat next to one another on the discharge conveyor by increasing the speed of this conveyor relative to the speed used to obtain a shingled arrangement during the slicing of each draft.

After a draft of slices has been cut and grouped onto the discharge conveyor 16, the draft is transported to a card dispensing position by the front conveyor 17 of a card dispenser 22. At the card dispenser 22, a paper card is placed beneath the draft. The draft is then moved by a rear conveyor 19 of the card dispenser 22 to the conveyor 25 of a second weighing scale 24. The weighing scale 24, which is referred to as a check weigher, measures the weight of the total draft. From the check weigher 24, the draft proceeds to the reject conveyor 26. The reject conveyor is operated in response to the weight of the draft as measured by the check weigher. If the measured weight of the draft falls within a range of acceptable values, the draft continues downstream to packaging and labelling equipment (not shown). If, however, the measured weight of the draft falls outside of this range, the draft is diverted by the reject conveyor to a make weight conveyor at a station (not shown) where an operator can manually adjust the weight of the draft to bring it within the desired limits.

The operation of the slicing machine is controlled by a suitably programmed digital controller 28. One example of a controller that can be employed in the context of the invention is a Giddings & Lewis PIC 409 programmable industrial computer. This computer receives input information from various devices within the slicing machine. For example, it receives draft weight information as determined by the first weigher 20 and the check weigher 24. It also receives data from resolvers associated with the slicing knife and the feed conveyor 11 to determine their instantaneous positions. In addition, it can receive information relating to the current drawn by the slicing knife motor for use in controlling the slicing knife motor speed as disclosed in detail in U.S. Pat. No. 4,552,048, which is hereby incorporated by reference.

In response to these signal inputs and the control program embodied in the memory of the controller 28, various output signals are produced to control the operation of devices within the slicing machine. In particular, the controller 28 controls the motor for the slicing knife of the slicer 14 and the motors for driving each of the conveyors 10, 11 and 16. In a preferred embodiment of the invention, the motors for each of the slicing knife and the rear conveyor 10 are operated in open-loop velocity control servo modes.

In contrast, the feed conveyor 11 is operated in a closed-loop position control servo mode by the controller 28. In this mode of operation, the position of the feed conveyor 11 is referenced to the instantaneous rotational position of the slicing knife so that changes in the rotational speed of the slicing knife, for example due to load variations or production speed changes, result in corresponding adjustment of the speed of the feed conveyor so as to maintain uniform slice thickness. To this end, the rotational position of the slicing knife can be detected, for example by means of a resolver, and applied as one input signal to the controller. The controller receives other input signals related to desired slice thickness and conveyor position, and in response thereto controls the feed conveyor motor to maintain the instantaneous position of the feed conveyor 11 commensurate with that of the slicing knife and desired slice thickness.

In particular, the programmable controller receives the dynamic weight data from the first weigher 20 and, in response to this data and other manually entered information relating to desired or target draft weight and desired number of slices, determines the proper thickness for the next slice to be cut as discussed previously. This value is then used to control the incremental positioning of the feed conveyor 11 to produce slices of appropriate thickness and hence weight. Further information pertaining to this operation is contained in commonly assigned, copending application Ser. No. 716,089, the disclosure of which is hereby incorporated by reference.

The discharge conveyor 16 is also operated in a closed-loop position control servo mode by the controller 28. Such control of the discharge conveyor provides better regulation of the grouping of slices into a shingled arrangement, a stacked arrangement, or an arrangement wherein the slices are laid next to one another.

Unlike the conveyors 10,11 and 16 which are controlled by the programmable controller 28, the conveyors in the card dispenser 22 and the check weigher 24 are controlled by these elements, respectively. In a preferred embodiment, the conveyors of the card dispenser 22 and the check weigher 24 are operated in an ordinary open-loop velocity control mode. Accordingly, when the card dispenser is turned on, a pre-established velocity control signal is supplied to each of the motors in these conveyors to permit the draft to be transported through the card dispenser and the check weigher.

Because it is important that each sliced draft be properly placed on a card at the card dispenser 22 in order to prevent the drafts from becoming disarranged, the use of a card dispenser monitor would be highly desirable. Accordingly, the slicing system as disclosed in FIG. 1 includes a monitoring circuit for detecting the failure of the card dispenser 22 to dispense a card beneath a sliced draft.

Figure 3:
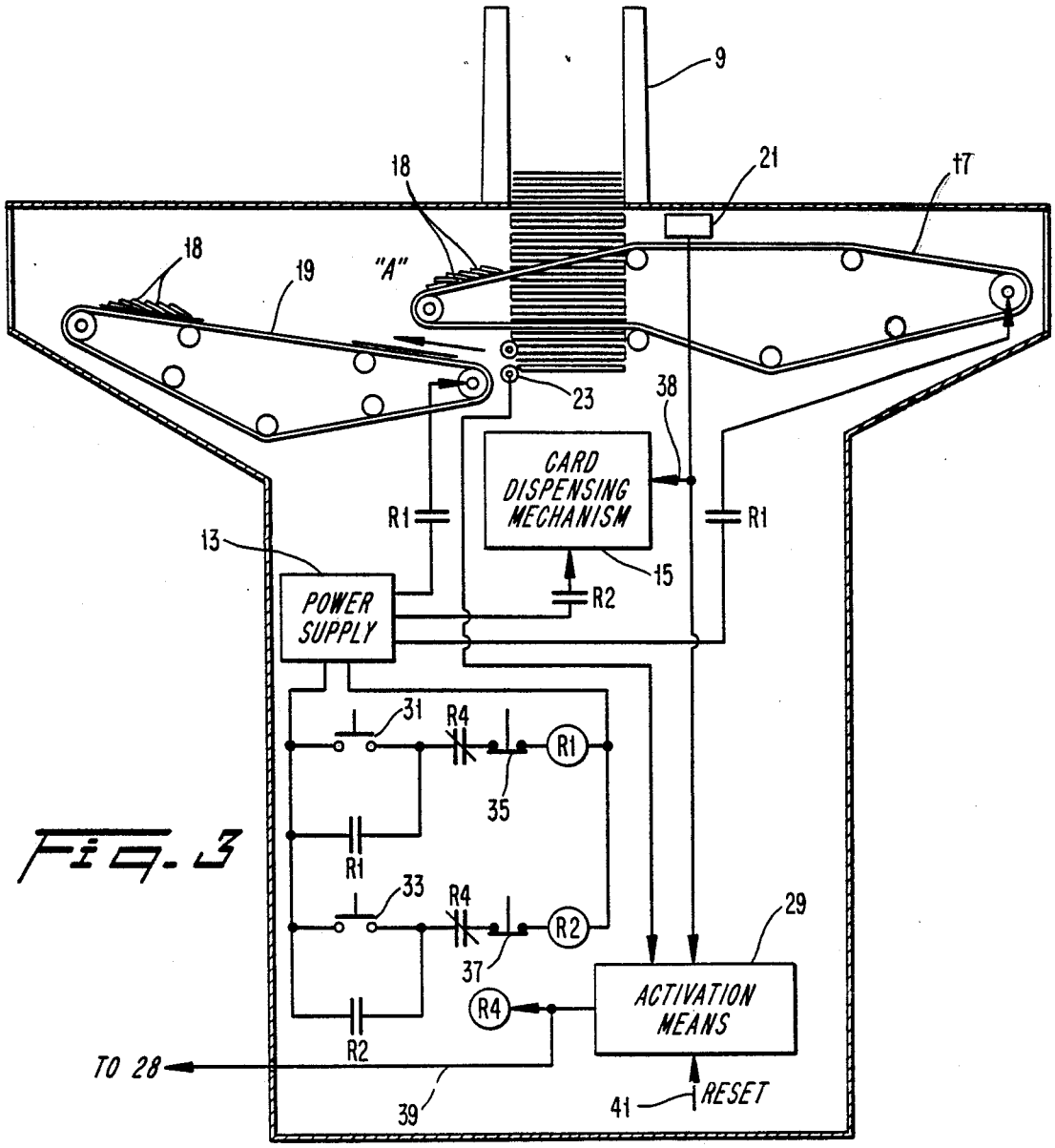
FIG. 3 is partial schematic cross-section of a card dispenser which includes a monitoring circuit in accordance with the present invention.

FIG. 3 shows one embodiment of a card dispenser employing a monitoring circuit in accordance with the present invention. The card dispenser used in the present invention is of a suitable and conventional type. Accordingly, only those elements of the card dispenser which are necessary for an understanding of the monitoring circuit of the present invention are included in FIG. 3.

As shown in FIG. 3, the card dispenser 22 includes a power supply 13 which provides power for the conveyor motors of the conveyors 17 and 19 via the normally opened motor relay contacts R1. The conveyor motors are controlled in an open-loop velocity mode as mentioned earlier. The speed setting for the conveyor motors could be set by providing an adjustable switch at the card dispenser, or alternatively, could be set at the control panel 27 of FIG. 1 and input to the card dispenser via the controller 28. The velocity of the conveyors 17 and 19 is adjusted so as to transport the drafts through the card dispenser at a pre-determined speed in synchronism with the rate at which drafts are provided to the card dispenser from the discharge conveyor.

A card vacuum suction device and card dispensing mechanism 15 as shown in FIG. 3 is also included in the card dispenser 22. The card dispensing mechanism 15 cyclically removes a card from a card reservoir magazine 9 and transports it to a card dispensing position "A" synchronously with the arrival of an approaching draft 18 in known fashion.

In operation, once the power supply 13 has been turned on, a conveyor start push button 31 and a card dispensing mechanism push button 33 can be depressed to initiate activation of these elements, respectively. More specifically, by momentarily depressing the push buttons 31 and 33, two relays R1 and R2 are activated to close the associated contacts labelled R1 and R2, respectively. Once closed, the contacts R1 and R2 permit power to be supplied to the conveyor motors and the card dispensing mechanism 15. The contacts R1 and R2 also maintain a closed circuit around the push buttons 31 and 33, respectively so that the relays R1 and R2 will remain energized following depression of the push buttons. Thus, operation of the card dispenser is permitted to continue until either a conveyor stop button 35 and a card dispensing mechanism stop button 37 are depressed or, until a set of normally closed relay contacts R4 are opened, as will be discussed below.

The normally closed relay contacts R4 remain closed provided the monitoring circuit does not produce a missing card function which would energize a missing card function relay R4. In accordance with the present invention, the monitoring circuit as shown in FIG. 3 includes the first sensor, or detector 21 placed upstream in the card dispenser relative to the card dispensing position "A". The sensor 21 detects the approach of a sliced draft of bacon toward the card dispensing position so that the card dispenser 22 will dispense a card in coincidence with the arrival of the draft at the position "A". The second sensor or detector 23 of the monitoring circuit is included with the card dispenser 22 to detect whether or not a card is actually dispensed.

The sensors 21 and 23 can be of any known type which will permit the above detections. For example, the sensor 21 can respond to a resetting of the first scale 20 to indicate transfer of a draft from the discharge conveyor 16 toward the card dispenser. The sensors 21 and 23 could also, for example, be optical sensors, retro-reflective sensors or other similar types of contact or non-contact sensors for detecting the transfer of a draft and the issuance of a card.

As shown in FIG. 3, the output signals from the sensors 21 and 23 are received by the activating means 29 of the monitoring circuit. The activating means is depicted in FIG. 3 as being located within the card dispenser machine 22. It should be noted, however, that the activation means could also be located separately from the card dispenser machine as well. Upon detecting that, for example, at least two consecutive card dispensing operations have not occurred, a missing card function is generated at the output of the activating means 29.

Figure 4:
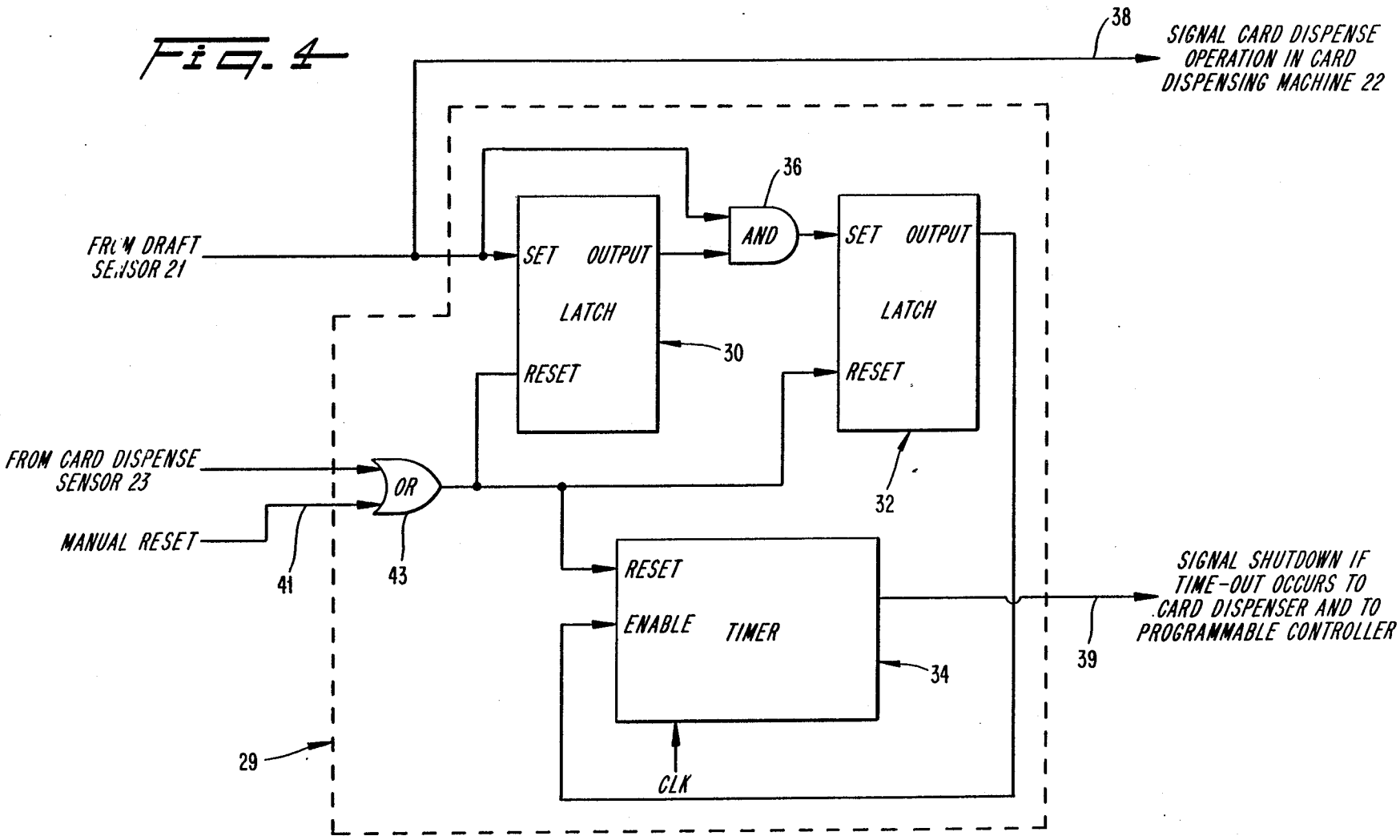
FIG. 4 is a more detailed diagram of a monitoring circuit used with the card dispenser of FIG. 1.

As shown in FIG. 4, one preferred embodiment of the activation means includes two latches 30 and 32, and a timer 34. The output of the first latch 30 is connected through an AND gate 36 to the set input of the second latch. The signal produced by the draft sensor 21 is applied to the set input of the latch 30, to a second input of the AND gate 36, and through line 38 directly to the card dispensing mechanism 15 of FIG. 3. The timer 34 of FIG. 4 receives a clock input, and in addition, is enabled by an output from the second latch 32. The signal produced by the card dispenser sensor 23 is applied as a reset signal to the latches 30, 32 and to the timer 34. When the timer 34 times-out, it outputs a high signal on the line 39 which is input to the missing card function relay R4 as shown in FIG. 3. The high signal on the line 39 is also input to the programmable controller 28 as shown in FIG. 1 to initiate a missing card function. A manual reset can be input to the activating means via the line 41 in FIG. 4 and the OR gate 43.

Figure 6:
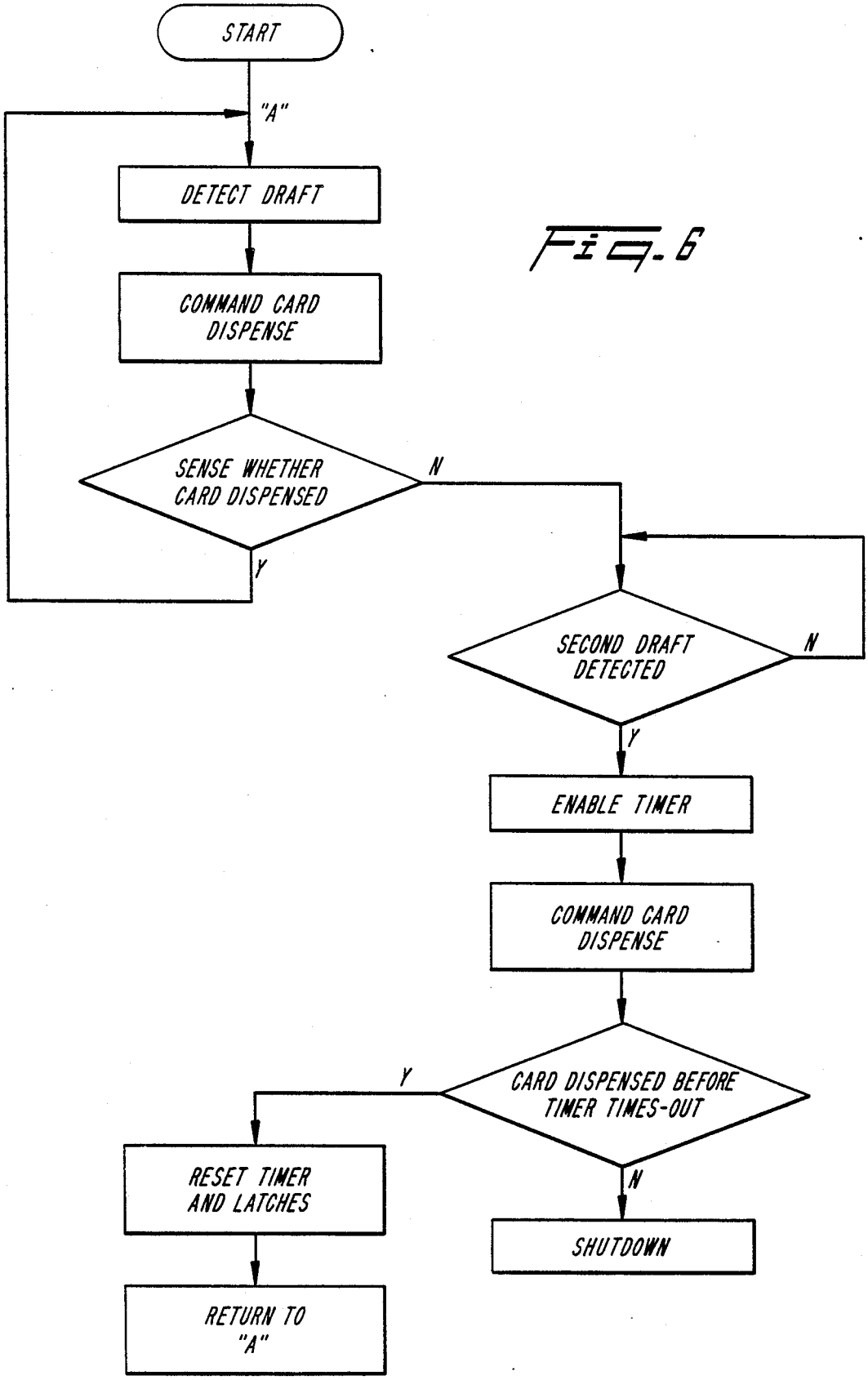
FIG. 6 shows a flow chart of one mode of operation of the present invention.

The operation of the FIG. 4 circuit will be discussed in conjunction with the flow chart of FIG. 6. As shown in FIG. 4, a draft which is approaching the card dispenser 22 is detected by the sensor 21. A signal produced by the sensor 21 is applied to the FIG. 3 card dispensing mechanism 15 of the card dispenser 22 so that the card dispenser 22 will dispense a card. The output signal from the sensor 21 is also applied to set the FIG. 4 latch 30. After a brief time delay, the latch 30 will apply a high signal to one input of the AND gate 36. The output of the AND gate 30 will, however, remain low until a subsequent high input signal is received from the draft sensor 21 at the second input.

If a card is subsequently dispensed in response to the command via the line 38 before the next draft is sensed, a signal output from the sensor 23 resets the latch 30. However, if a card is not dispensed when the next draft is detected by the sensor 21, the high signal from the sensor 21, combined with the high output from the latch 30 will set the second latch 32 via the AND gate 36. The output of the latch 32 will in turn enable the timer 34. In addition, the signal from the sensor 21 will, via the line 38, again command the card dispensing mechanism to dispense a card.

If a card is dispensed before the timer 34 times-out, a signal from the sensor 23 will reset the timer 34 and the latches 30 and 32 so that normal operation will continue. However, if no such card is dispensed due to, for example, a jammed condition in the card dispenser or a failure by the operator to fill the card holding magazine of the card dispenser, then the timer 34 will time-out. The time-out cycle of the timer 34 can be adjusted by the operator, but should be set no greater than the time period between the transport of successive drafts to the card dispenser. As a result of the above time-out operation, a signal will be directed to the missing card function relay R4 and to the controller 28 via the line 39 to activate a missing card operation of the slicing machine.

Thus, if the monitoring circuit detects that the card dispenser 22 has failed to dispense a card on two consecutive occasions, the card dispenser 22 and the programmable controller 28 will initiate a missing card function. That is, the output on the line 39 to the controller 28 will cause the feed conveyor 11 of the slicer to be sopped so that no more drafts will be sliced.

In addition, the signal output on the line 39 will cause operation of the card dispenser to be stopped. More specifically, the signal on the line 39 will cause the FIG. 3 relay R4 to become energized, thus opening the normally closed contacts R4 which are located in series with the relays R1 and R2. The relays R1 and R2 thus become deenergized so as to interrupt operation of the card dispenser. More specifically, the de-energization of the relay R2 causes the associated contacts R2 to open and the operation of the card dispensing mechanism 15 to be interrupted. The de-energization of the relay R1 will cause the associated contacts R1 to open and thus cause the front conveyor 17 of the card dispenser 22 to be stopped. Accordingly, subsequent drafts will be prevented from being presented to the card dispensing position. Likewise, the opening of the contacts R1 causes the rear conveyor of the card dispenser to be stopped so that the transfer of uncarded drafts from the card dispensing position to the reject conveyor is prohibited.

Drafts located downstream of the card dispenser which have already been properly carded, however, may be permitted to complete their processing through the reject conveyor 26 to the make-weight conveyor and packaging machine. Alternatively, the entire slicing machine system, including controlled elements downstream of the card dispenser could be shutdown in response to the signal used to activate a missing card function if desired.

Upon occurrence of a shutdown as described above, operation remains shutdown until a reset means is activated. The reset means includes a button on the system control panel 27. A reset means for the card dispenser 22 could alternatively be provided on the card dispenser itself. In either case, upon activation of the reset means, operation of the feed conveyor 11 of the slicer would again be enabled after which the feed conveyor could be restarted.

In addition, the latches and timer of the activating means would be reset via, for example, the manual reset 41 and the OR gate 43 of FIG. 4. Following depression of the reset button, the output on the line 39 from the activation means would disappear so that the FIG. 3 relay R4 would again become de-energized, thus permitting the associated contacts R4 to close. Operation of the card dispenser conveyors and the card dispenser would not however, automatically resume. That is, since contacts R1 and R2 have been placed in parallel with the start push buttons 31 and 33, respectively, these push buttons must again be temporarily depressed so that the contacts R1 and R2 will again be closed.

Accordingly, following the occurrence of a missing card operation, the reset means must first be activated, followed by depression of the card dispenser start buttons to resume operation. By requiring the detection of at least two consecutive failures of the card dispenser before initiating a shutdown, as discussed above, nuisance stoppages of the slicing machine are avoided.

Figure 5:
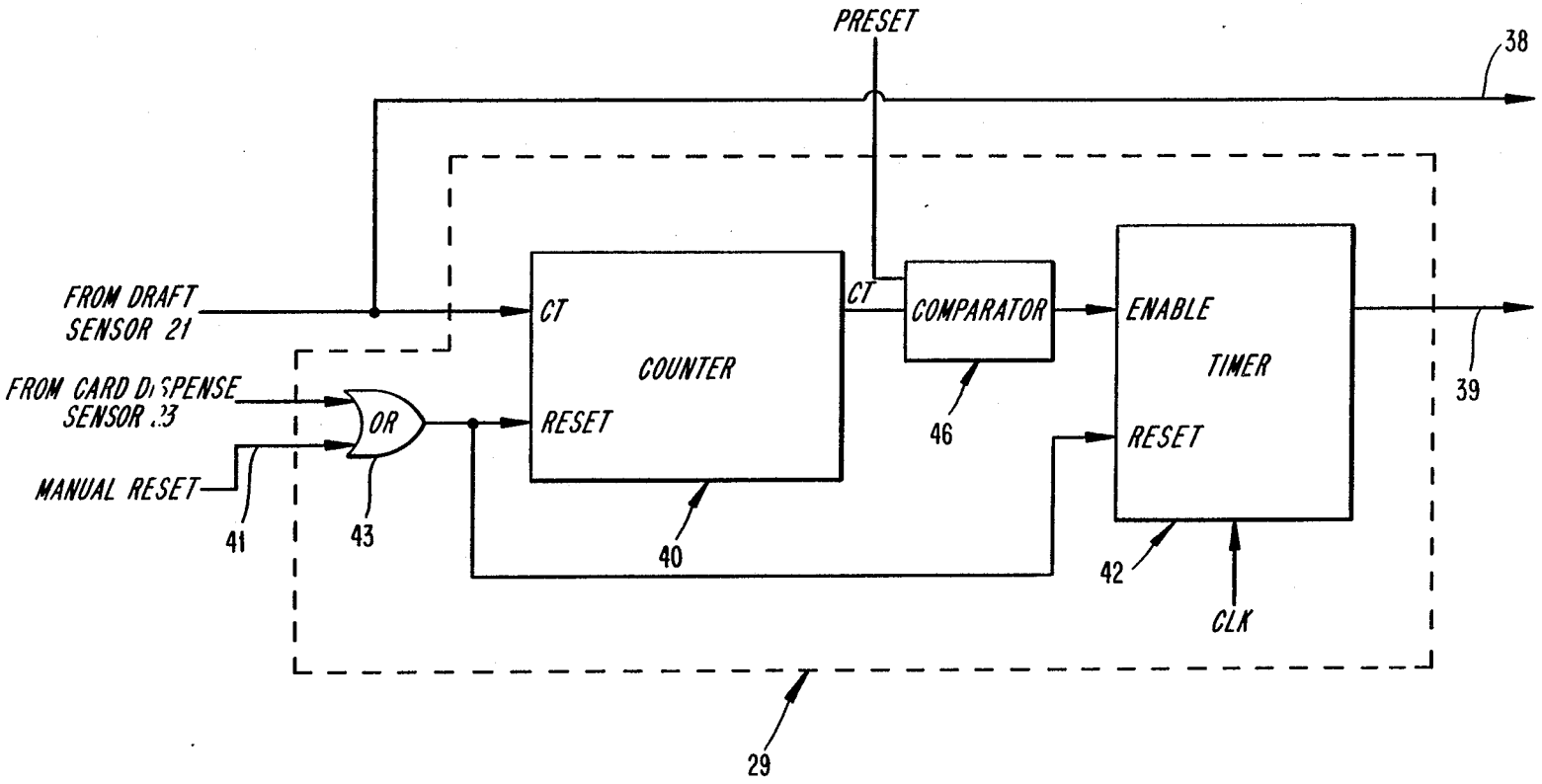
FIG. 5 shows a second embodiment of the monitoring circuit.

In FIG. 5, a second embodiment of the monitoring circuit for activating a missing card function is shown. In this embodiment, the activation means 29 includes a counter 40, a comparator 46 and a timer 42. Each time a draft is detected by the sensor 21, an input to the counter 40 causes the count to increase by one. The count will continue to increase unless a card is dispensed as detected by the sensor 23. The output of the counter 40 is compared with a preset number in the comparator 46. When the output of the counter 40 is equal to the preset number, the timer 42 is enabled. If the timer is reset by an output of the card sensor 23 before it times-out, operation of the slicing machine will continue as normal. If however the timer is permitted to time-out, a signal on the line 39 will be applied to the missing card function relay R4 and to the programmable controller 28 in order to activate a missing card operation as discussed with respect to FIG. 4.

With the FIG. 5 monitoring circuit, the operator can select the number of card dispensing failures which will initiate a slicing machine stoppage by adjusting the preset count input to the comparator 46. Upon the occurrence of a missing card operation, the system can again be restarted by activating a manual reset 41 via an OR gate 43, followed by depressing start buttons as discussed with respect to FIG. 4.

It will be appreciated by those of ordinary skill in the art that the present invention can be embodied in other specific forms without departing from the spirit or essential characteristics thereof. The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. A method for controlling a slicing machine of the type in which a product is advanced into a continuously rotating cutting knife, comprising the steps of:

cutting and grouping slicing of the product into drafts;

transporting said drafts to a card dispensing position in a card dispensing machine;

detecting the approach of a draft to said card dispensing position;

detecting whether a card has been dispensed by said card dispensing machine;

activating a missing card function when the dispensing of a card is not detected despite prior detection of an approaching draft to the card dispensing position; and wherein said missing card function is only activated if the dispensing of a card is not detected during the occurrence of at least two consecutive draft approach detections.

2. An apparatus for controlling a slicing machine of the type in which a product is advanced into a continuously rotating cutting knife, comprising:

means for cutting and grouping slices of the product into drafts;

means for transporting said drafts to a card dispensing position in a card dispensing machine;

a circuit for monitoring said card dispensing machine, said circuit further including:

a first sensor for detecting the approach of a draft to said card dispensing position;

a second sensor for detecting whether a card has been dispensed by said card dispensing machine; and means for activating a missing card function when said first sensor detects the approach of a draft to the card dispensing position but said second sensor does not detect that a card has been dispensed; and wherein said missing card function includes halting normal operation of said cutting and grouping means and said transporting means.

3. The apparatus of claim 2, wherein said missing card function additionally causes processing of drafts which have already received cards to be completed.

4. A method for controlling a slicing machine of the type in which a product is advanced into a continuously rotating cutting knife, comprising the steps of:

cutting and grouping slices of the product into drafts;
transporting said drafts to a card dispensing position in a card dispensing machine;
detecting the approach of a draft to said card dispensing position;
detecting whether a card has been dispensed by said card dispensing machine;
activating a missing card function when the dispensing of a card is not detected despite prior detection of an approaching draft to the card dispensing position; and
wherein said step of activating a missing card function further comprises the step of:
halting further operation of said cutting and grouping step and said transporting step.

5. The method of claim 4, wherein said step of activating a missing card function further comprises the step of:
completing any processing of drafts which have already received cards.

6. An apparatus for controlling a slicing machine of the type in which a product is advanced into a continuously rotating cutting knife, comprising:
means for cutting and grouping slices of the product into drafts;
means for transporting said drafts to a card dispensing position in a card dispensing machine;
a circuit for monitoring said card dispensing machine, said circuit further including:
a first sensor for detecting the approach of a draft to said card dispensing position;
a second sensor for detecting whether a card has been dispensed by said card dispensing machine; and
means for activating a missing card function when said first sensor detects the approach of a draft to the card dispensing position but said second sensor does not detect that a card has been dispensed; and
wherein said means for activating includes two latch means and a timer means.

7. An apparatus for controlling a slicing machine of the type in which a product is advanced into a continuously rotating cutting knife, comprising:
means for cutting and grouping slices of the product into drafts;
means for transporting said drafts to a card dispensing position in a card dispensing machine;
a circuit for monitoring said card dispensing machine, said circuit further including:
a first sensor for detecting the approach of a draft to said card dispensing position;
a second sensor for detecting whether a card has been dispensed by said card dispensing machine; and
means for activating a missing card function when said first sensor detects the approach of a draft to the card dispensing position but said second sensor does not detect that a card has been dispensed; and
wherein said means for activating includes a counter having an output and timer means, whereby said timer is enabled when the output of said counter attains a predetermined count.

8. The apparatus of claim 7, wherein said predetermined count can be adjustably present by an operator.

9. An apparatus for controlling a slicing machine of the type in which a product is advanced into a continuously rotating cutting knife, comprising:
means for cutting and grouping slices of the product into drafts;
means for transporting said drafts to a card dispensing position in a card dispensing machine;
a circuit for monitoring said card dispensing machine, said circuit further including:
a first sensor for detecting the approach of a draft to said card dispensing position;
a second sensor for detecting whether a card has been dispensed by said card dispensing machine; and
means for activating a missing card function when said first sensor detects the approach of a draft to the card dispensing position but said second sensor does not detect that a card has been dispensed; and
wherein said missing card function is not activated unless said second sensor does not detect that a card has been disposed during the time that the approach of at least two consecutive drafts to said card dispensing position has been detected.

* * * * *